US005772396A

United States Patent [19]

Rockwood

[11] Patent Number: 5,772,396

[45] Date of Patent: Jun. 30, 1998

[54] PUMP HAVING FLUSH SYSTEM FOR SEAL ARRANGEMENT

[75] Inventor: Robert E. Rockwood, Windham, N.H.

[73] Assignee: Environamics Corporation, Hudson, N.H.

[21] Appl. No.: 695,660

[22] Filed: May 15, 1996

[51] Int. Cl.[6] ..... F04D 29/12

[52] U.S. Cl. ..... 415/112; 415/111; 415/113; 415/180; 277/24; 277/74

[58] Field of Search ..... 415/111, 112, 415/113, 176, 180, 230, 231; 277/24, 71, 74, 81 R

[56] References Cited

U.S. PATENT DOCUMENTS

| | | | |
|---|---|---|---|
| 3,612,548 | 10/1971 | Tracy | 277/74 |
| 3,850,550 | 11/1974 | Kaessen | 415/111 |
| 4,328,973 | 5/1982 | Delbridge | 277/71 |
| 5,203,575 | 4/1993 | Azibert et al. | 277/74 |

FOREIGN PATENT DOCUMENTS

| | | | |
|---|---|---|---|
| 2950445 | 6/1981 | Germany | 415/111 |
| 1719723 | 3/1992 | U.S.S.R. | 415/230 |

*Primary Examiner*—Christopher Verdier
*Attorney, Agent, or Firm*—Myers Liniak & Berenato

[57] ABSTRACT

A centrifugal pump having a sealing flushing system. An annular flush ring insert having a plurality of radially spaced flush holes is provided adjacent the seal to be flushed so as to permit the seal to be flushed at a number of different places around the pump shaft and from a plurality of different radially spaced directions. The flushing fluid flows through a gland, into and through the flush ring insert, flushes (i.e. cleans and/or cools) the seal, and then flows on into the fluid being pumped.

19 Claims, 4 Drawing Sheets

59
37
33
75
41
91
51
73
57
53
55
47
99
45
81
43
35
31
103
101
49
41
87
81
73
35
43
37
63
33
73
61

PUMP HAVING FLUSH SYSTEM FOR SEAL ARRANGEMENT

This invention relates to a seal flushing system for use in a centrifugal chemical processing pump or the like. More particularly, this invention relates to a seal flushing system including an annular insertable 360° flushing ring disposed around the seal to be flushed, the flush ring having defined therein a plurality of flush holes or apertures so that the seal is simultaneously flushed at a plurality of different locations and from a plurality of different directions.

BACKGROUND OF THE INVENTION

Centrifugal chemical processing pumps are old and well-known in the art. For example, FIG. 1 is a side cross-sectional view of a prior art centrifugal chemical processing pump. The FIG. 1 pump includes motor 3, rotatable shaft 5, pump housing 7, fluid pumping impeller 9 for pumping the fluid to be pumped from inlet 11 to outlet 13, lubrication chamber 15, seals 17, inboard shaft supporting ball bearings 18, outboard shaft supporting ball bearings 19, annular stationary member 21, annular gland 23, fluid pumping chamber 25, casing 27, and finally support member 29. In short, motor 3 functions to drive or rotate pump shaft 7 which in turn causes impeller 9 to rotate within chamber 25. This causes the fluid to be pumped from inlet 11 to be pumped out of outlet 13. Seals 17 seal the fluid being pumped against axial movement rearward along shaft 5 toward motor 3 and the atmosphere.

Seal flushing systems for use in conjunction with centrifugal pumps are old and well-known throughout the art. A typical flushing system includes a passageway for permitting a flushing liquid to flow up against a sealing interface for the purpose of cleaning/cooling the sealing interface which typically includes both a stationary and a rotating member. Unfortunately, such typical flushing systems have the following disadvantages. Firstly, because the flush liquid flows up against the seal only at a single point, the stationary sealing member (e.g. carbon ring) tends to wear out more quickly at this point thereby resulting in premature seal failure. Secondly, the insertion of a flush liquid at only a single point up against a seal such as this tends to flush the seal more thoroughly in certain areas as opposed to around the entire circumference of the seal. Thirdly, when the system breaks down, typically the entire gland must be replaced thereby necessitating substantial cost and labor.

It is apparent from the above that there exists a need in the art for a pump including a seal flushing system wherein: (i) the problem of premature wear in local areas of the seal is overcome; (ii) breakdown of certain portions of the flushing system does not necessitate replacement of the entire gland; (iii) the fluid being pumped may also be used to flush the seal; and (iv) the seal is flushed in an efficient manner around its entire periphery, not just in local areas.

It is the purpose of this invention to fulfill the above-described needs in the art, as well as other needs apparent to the skilled artisan from the following detailed description of this invention.

SUMMARY OF THE INVENTION

Generally speaking, this invention fulfills the above-described needs in the art by providing a centrifugal pump for pumping a fluid to be pumped, the pump having a flush system for flushing a seal arrangement, the centrifugal pump comprising:

- a motor;
- a fluid pumping impeller;
- a shaft disposed between the motor and the impeller so that the motor can drive or rotate the shaft and the impeller;
- at least one seal having an annular rotating sealing member affixed to the shaft for rotation therewith and an annular stationary sealing member, said rotating and stationary sealing members working together to form a fluid sealing interface therebetween;
- a gland encircling at least a portion of the seal and the shaft, the gland including a fluid port therein for allowing a flush liquid to flow therethrough toward the sealing interface;
- an annular removable insert flush ring disposed around the shaft, the flush ring being located between the gland and the seal; and
- wherein the flush ring has a plurality of flush apertures or holes defined therein adjacent the seal, the flush apertures being radially spaced from one another around the shaft for permitting the flush liquid from the port to flow through the flush apertures in the flush ring so that the flush liquid flows by the sealing interface thereby cleaning the seal.

According to certain embodiments of this invention, it is an object to provide a flush system for a pump which utilizes the fluid being pumped to flush the seal. Alternatively, the flush liquid (e.g. water) can come from an external source.

This invention still further fulfills the above-described needs in the art by providing a flush system for flushing a seal in a pump, the system comprising:

- a seal having an annular fluid sealing interface adapted to surround a rotatable shaft;
- a gland surrounding at least a portion of the seal;
- a stuffing box of the pump disposed adjacent the gland and also surrounding at least a portion of the seal; and
- an annular flush ring disposed between the gland and the stuffing box for enabling flushing of the seal via a plurality of flush holes defined in the flush ring.

This invention still further fulfills the above-described needs in the art by providing a seal system adapted to be used in a centrifugal pump or the like, the seal system comprising:

- an annular rotating sealing member adapted to be affixed to a rotatable shaft for rotation therewith;
- an annular stationary sealing member which forms a fluid sealing interface together with the rotating sealing member;
- a gland surrounding at least one of the annular stationary sealing member and the rotating sealing member, the gland including a flush passage defined therein for allowing flush liquid to flow toward the sealing interface; and
- an annular flush ring disposed between the gland and the sealing interface, the flush ring including a plurality of radially spaced apart flush passageways defined therein for allowing the flush liquid to flow toward the sealing interface.

This invention will now be described with respect to certain embodiments thereof, accompanied by certain illustrations, wherein:

IN THE DRAWINGS

DETAILED DESCRIPTION OF CERTAIN EMBODIMENTS OF THIS INVENTION

Figure 1:
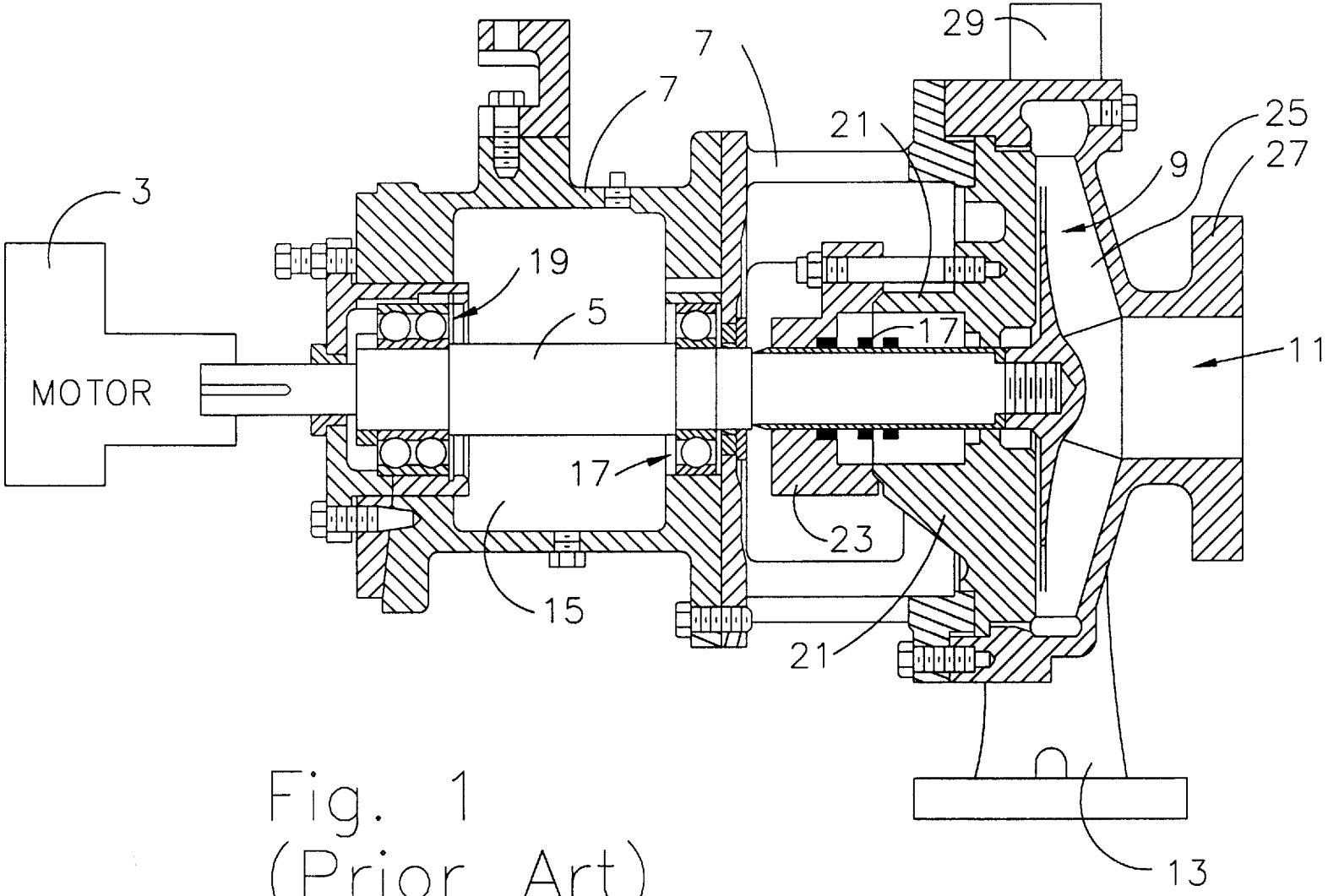
Fig. 1 (Prior Art)
FIG. 1 is a side cross-sectional view of a prior art centrifugal pump.

Referring now more particularly to the accompanying drawings in which like reference numerals indicate like parts throughout the several views.

Figure 2:
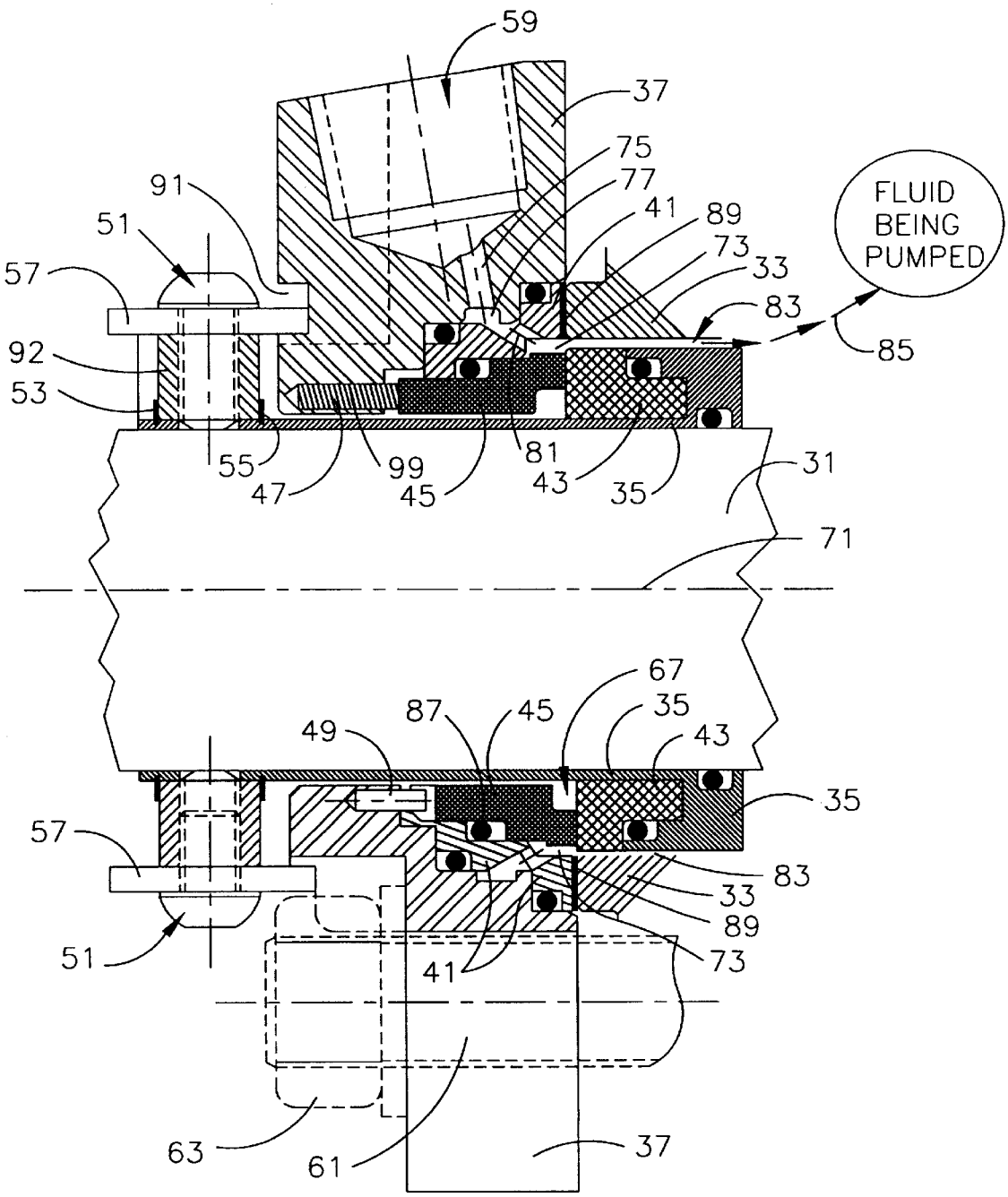
FIG. 2 is a side cross-sectional view of a portion of a centrifugal pump according to an embodiment of this invention, FIG. 2 illustrating a seal flushing system according to a preferred embodiment of this invention.

FIG. 2 is a side cross-sectional view of a portion of a centrifugal pump according to an embodiment of this invention. FIG. 2 illustrates the section of the pump in which the majority of the seal flushing system according to this embodiment is located. The remainder (e.g. shaft, motor, impeller, etc.) of the centrifugal pump according to this embodiment, exclusive of the flushing system, is disclosed, for example, in U.S. Pat. No. 5,494,299, the disclosure of which is hereby incorporated herein by reference, or in FIG. 1.

The centrifugal pump according to the FIG. 2 embodiment includes rotatable pump shaft 31 (illustrated non-cross-sectionally) adapted to be driven by the pump motor, stationary pump stuffing box 33, seal sleeve 35 affixed to shaft 31 for rotation therewith, gland 37 which remains stationary while shaft 31 rotates, removable flush ring insert 41, a seal made up of annular rotating sealing member 43 which rotates along with shaft 31 and stationary annular sealing member 45, a plurality of radially spaced biasing springs 47, a plurality of radially spaced anti-rotation pins 49, a plurality of radially extending set screws 51, snap ring 53, snap ring 55, temporary washers 57, flush port 59, and finally mounting bolts 61 with corresponding nuts 63 for attaching the flush/seal gland 37 to stuffing box 33 and thus the pump.

With regard to the seal, annular rotating sealing member 43 is attached to sleeve 35 so as to rotate along with shaft 31. Its companion, annular stationary sealing member 45, remains stationary along with gland 37 during pump operation. A plurality of radially spaced springs 47 mounted in spring holes defined in gland 37 function to bias or urge annular member 45 into fluid sealing interface 67 with rotating sealing member 43. Thus, sealing interface 67 is created.

A plurality of radially spaced anti-rotation pins 49, also mounted in gland 37, are provided for maintaining stationary sealing member 45 against rotation. In other words, pins 49 keep member 45 from rotating along with pump shaft 31. According to certain embodiments of this invention, anti-rotation pins 49 and biasing springs 47 are mounted in gland 37 at close to or substantially the same radius relative to pump center 71. Thus, pins 49 and springs 47 are located around shaft 31 in an alternating manner at this radius. According to certain embodiments, from about eight to twelve springs 47 may be provided in gland 37 along with approximately two anti-rotation pins 49.

Annular gland 37 extends radially outward from sleeve 35 and thereby surrounds pump shaft 31 on all sides. A single flush port 59 is defined in gland 37 for the purpose of allowing the flush liquid to flow toward annular flush chamber 73. Annular flush chamber 73 surrounds the exterior periphery of each of rotating sealing member 43, stationary sealing member 45, and fluid sealing interface 67.

In fluid communication with flush port 59 is passageway 75 (defined in gland 37) and annular flow chamber 77. Chamber 77 surrounds pump shaft 31 and is located between the inner periphery of a portion of gland 37 and the exterior periphery of a portion of flush ring insert 41. Pressurized flushing liquid flowing through port 59 and passageway 75 flows into chamber 77 and flows through this chamber around shaft 31. From annular flow chamber 77, the flushing liquid proceeds through a plurality of radially spaced flush apertures or holes 81 defined in flush ring insert 41 and into annular flush chamber 73 so as to flush sealing interface 67.

By providing a plurality of radially spaced flush apertures 81 around the circumference of shaft 31 and interface 67, the resulting flush flow into chamber 73 is akin to a shower-head effect in that the seal interface 67 is flushed at a plurality of different locations along its periphery with substantially the same force at each place. Thus, the prior art problem of localized seal wear due to localized flushing is overcome.

After the liquid (e.g. either water or the liquid being pumped) in chamber 73 flushes (i.e. cleans and/or cools) sealing interface 67, sealing member 43, and sealing member 45, the liquid flows axially along shaft 31 through annular exit passageway 83 so that the flush liquid may makes it way into the fluid being pumped as shown at 85.

Dynamic O-ring 87 is provided between the exterior periphery of stationary sealing member 45 and the inner periphery of a portion of flush ring 41 for the purpose of sealing both the flush liquid and the fluid being pumped from the surrounding atmosphere. As illustrated, a plurality of independent O-rings are utilized throughout the system of this embodiment for the purpose of sealing and maintaining and stabilizing the mechanical components against movement.

The single cartridge seal illustrated in FIG. 2 is a balanced type seal which utilizes a carbon monolithic design so that the seal, when heated, is less susceptible to losing its flatness at interface 67. Additionally, annular seal 89 is provided between stuffing box 33 and an axial face of flush ring 41 for the purpose of sealing the flush chamber from the atmosphere.

Flush ring 41, according to certain embodiments of this invention is both substantially Z-shaped and takes the form of a removable insert. With regard to its removability, this is important because, if the flush system should require repair, the entire gland, including the seal, does not need to be replaced. Flush ring 41 may be replaced simply by loosening nuts 63 and bolts 61, pulling gland 37 axially leftward away from stuffing box 33, and removing flush ring 41 so that another can be inserted. In such a manner, replacement of flush ring 41 is simplistic.

The substantially Z-shaped cross-sectional design of flush ring 41 is provided so that flush apertures 81 may be angled relative to the axis of shaft 31 thereby allowing the flush liquid (e.g. water) to flow into annular chamber 73 at an angle so as to reduce wear upon sealing member 45. The angle at which flush apertures 81 are designed in ring 41 may be from about 50° to 60° relative to the shaft axis (preferably from about 20° to 40°) such that the liquid flowing into chamber 73 through flush apertures 81 enters the chamber at the same angle. At least one of the flush aperture axes is angled from about 20° to 40° relative to the shaft axis.

Only a single port 59 is defined in gland 37. Thus, all flushing liquid which makes its way into chamber 73 comes from this single port 59 and a single passageway 75. Once flowing circumferentially around shaft 31 within chamber 77, the flush liquid makes, for example, right-hand turns into corresponding flush apertures 81 so as to flow into chamber 73 from a plurality of different directions at a plurality of different points around shaft 31. In such a manner, sealing interface 67 is maintained in a cleaned and temperature stabilized (i.e. cooled) state.

A plurality of set screws 51 (e.g. from about four to eight such screws) are provided around shaft 31 for the purpose of securing sleeve 35 to the shaft and for helping in the installation of gland 37. Temporary was hers 57 are also provided to help out in gland installation. A notch 91 is provided in gland 37 (facing the motor end of the pump) so as to correspond with each set screw 51 and washer 57. During installation, washer 57 is utilized in conjunction with the flat faces of notch 91 to (i) stabilize gland 37 against axial and radial movement during installation; and (ii) to stabilize the gland so that springs 47 may be compressed properly. Snap rings 53 and 55 are provided adjacent member 92 for stabilization purposes.

Figure 3:
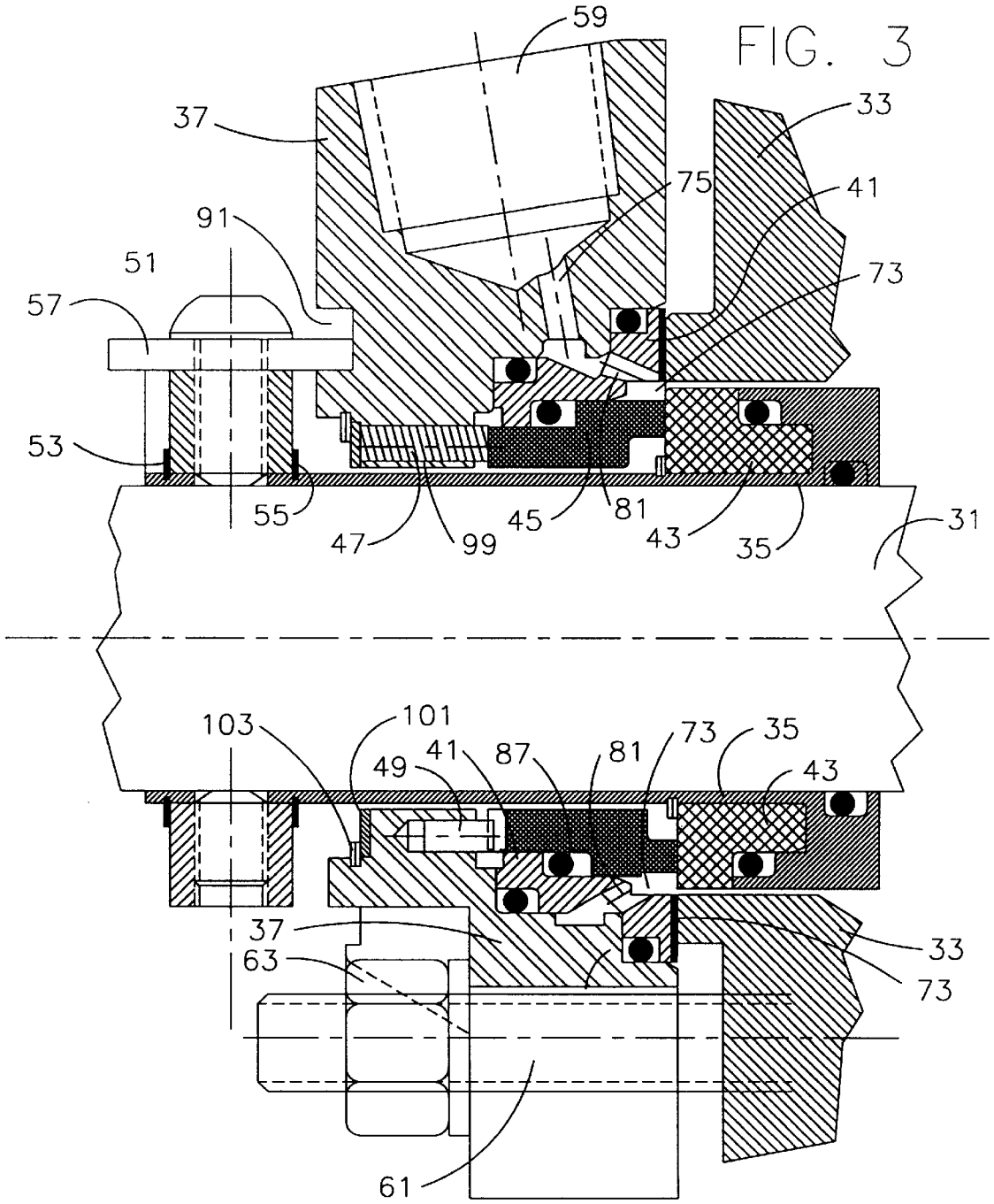
FIG. 3 is a side cross-sectional view of a portion of a centrifugal pump according to another embodiment of this invention, FIG. 3 illustrating a seal flushing system according to this another embodiment.

FIG. 3 is a side cross-sectional view of the seal flushing system used in conjunction with the centrifugal pump according to another embodiment to this invention. The FIG. 3 embodiment is similar to the FIG. 2 embodiment except for the position of springs 47 and spring holes 99 in which they are positioned. In the FIG. 2 embodiment, spring holes 99 were located radially relative to shaft 31, entirely below or inside of the inner diameter of ring 41. Thus, in the FIG. 2 embodiment, sealing member 45 could be removed, and springs 47 inserted into corresponding spring holes 99 without disturbing flush ring 41. However, in the FIG. 3 embodiment, spring holes 99 are partially located radially outward relative to the inner peripheral diameter of flush ring 41. Thus, in the FIG. 3 embodiment, in order to replace a spring 47 from the impeller side of the pump, both flush ring 41 and sealing member 45 would have to be removed. This is undesirable.

Accordingly, because spring holes 99 in the FIG. 3 embodiment are positioned partially radially outward relative to the inner diameter of flush ring 41, hole 99 is drilled all the way through gland 37 and annular washer 101 is provided to form the bottom of the spring holes according to this embodiment. Snap rings 103 are provided to keep washer 101 in place against axial movement. It is also worth pointing out, that according to alternative embodiments of this invention, flush ring 41 may be made integral with gland 37.

Figure 4:
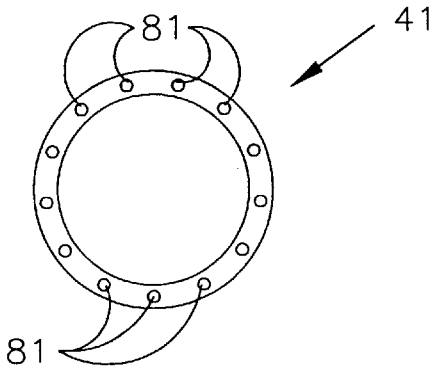
FIG. 4 is an end view of the 360° flush ring insert.

FIG. 4 is a simplified end view of flush ring 41 according to either the FIG. 2 or FIG. 3 embodiment, this figure leaving out many details of 360° flushing ring 41 for purposes of simplicity. As illustrated in FIG. 4, the plurality of flush holes 81 are radially spaced around the periphery of the pump shaft so that the flush liquid makes its way into chamber 73 simultaneously at a plurality of different locations and from a plurality of radially inward different directions.

Figure 5:
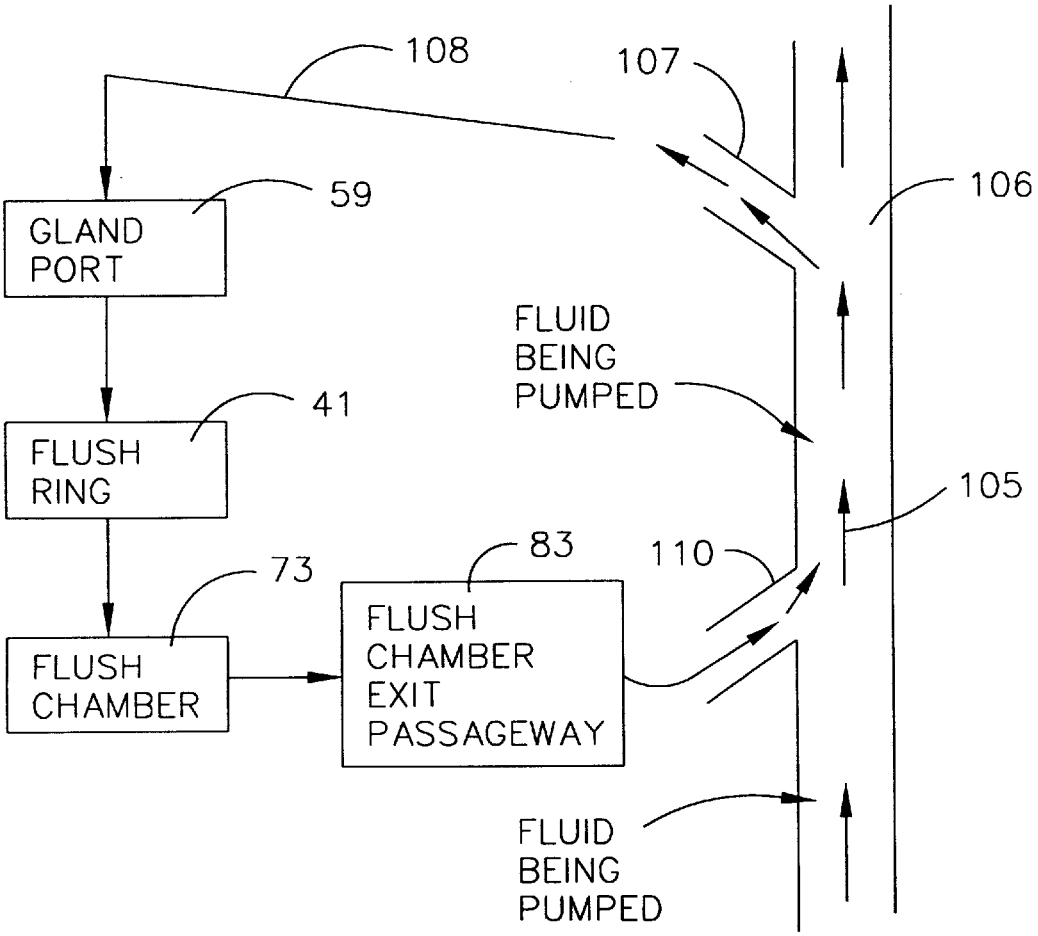
FIG. 5 is a schematic/block diagram illustrating, according to an embodiment of this invention, how the fluid being pumped is utilized in order to flush the seal in either the FIG. 2 or FIG. 3 flushing system embodiment according to this invention.

FIG. 5 is a schematic/block diagram illustrating the flushing system according to certain embodiments of this invention where the fluid being pumped is utilized as the flushing liquid in the system. As shown in FIG. 5, the fluid being pumped 105 has its conventional flow through the pumping chamber. However, according to this invention, this same fluid may be circulated through the flushing system and used to flush the seal so that a separate flushing liquid is not required. As shown in FIG. 5, part of the fluid being pumped exits the regular flow channel 106 at 107 and thereafter makes its way to gland port 59 by way of conduit 108. From port 59, the flushing liquid makes its way radially inward toward the shaft through passage 75 and into annular chamber 77 where the liquid flows circumferentially around shaft 31. From chamber 77, the flushing liquid flows radially inward at an angle through the plurality of radially spaced flush apertures 81 defined in insert ring 41 and into flushing chamber 73. After the sealing interface 67 is cleaned and/or cooled, the flushing liquid makes its way through annular passageway 83 and back into the fluid being pumped at 110.

Alternatively, the flushing liquid may come from an independent external source and, after flushing the seal, may proceed to be mixed with the fluid being pumped.

Once given the above disclosure, therefore, various other modifications, features, or improvements will become apparent to the skilled artisan. Such other features, modifications, and improvements are thus considered a part of this invention, the scope of which is to be determined by the following claims.

I claim:

1. A centrifugal pump for pumping a fluid, the pump having a flush system, the centrifugal pump comprising:

a motor;

a fluid pumping impeller;

a shaft disposed between said motor and said impeller so that said motor can drive or rotate said shaft and said impeller;

at least one seal having an annular rotating sealing member affixed to said shaft for rotation therewith and an annular stationary sealing member, said rotating and stationary sealing members working together to form a fluid sealing interface therebetween;

a gland encircling at least a portion of said at lease one seal and said shaft, said gland including a fluid port therein for allowing a flush liquid to flow therethrough toward said sealing interface;

an annular removable insert flush ring that is not part of said at least one seal, said flush ring being disposed around said shaft, said flush ring being located between said gland and said at least one seal; and wherein said flush ring has a plurality of radially spaced flush apertures defined therein adjacent said at least one seal, said plurality of flush apertures being radially spaced from one another around said shaft for permitting the flush liquid from said port to flow through said flush apertures in said flush ring into an annular flush chamber that surrounds said at least one seal, so that the flush liquid flows by said sealing interface thereby cleaning said seal; and wherein said apertures defined in said flush ring include means for enabling the flush liquid to flow into said annular chamber from a plurality of different directions at the same time.

2. The centrifugal pump of claim 1, wherein said shaft defines an axis about which said rotating sealing member rotates, and said flush apertures also define flush axes, and wherein said flush aperture axes are angled from about 5° to 60° relative to said shaft axis.

3. The centrifugal pump of claim 2, wherein at least one of said flush aperture axes is angled from about 20° to 40° relative to said shaft axis.

4. The centrifugal pump of claim 1, further comprising a dynamic O-ring disposed between the outer periphery of said annular stationary sealing member and the inner periphery of said insert flush ring.

5. The centrifugal pump of claim 4, wherein said dynamic O-ring is for sealing the fluid to be pumped from the atmosphere.

6. The centrifugal pump of claim 1, further comprising a plurality of biasing springs mounted in said gland at a given radius about said shaft, said plurality of biasing springs for urging said stationary sealing member toward said rotating sealing member so as to create said sealing interface.

7. The centrifugal pump of claim 6, further comprising a plurality of anti-rotation pins mounted in said gland for preventing rotation about said shaft of said stationary sealing member.

8. The centrifugal pump of claim 7, wherein said anti-rotation pins are located around said shaft at substantially said given radius.

9. The centrifugal pump of claim 1, wherein said flush ring is substantially Z-shaped as viewed cross-sectionally.

10. The centrifugal pump of claim 9, wherein a portion of the Z-shaped cross-section is substantially parallel to said shaft.

11. The centrifugal pump of claim 10, wherein said flush apertures in said insert are located adjacent the junction between the connecting portion and one of the parallel portions of the Z-shaped cross-section.

12. The centrifugal pump of claim 1, further including a passageway for allowing the flush liquid to flow into the fluid being pumped after it cleans said at least one seal.

13. A seal system adapted to be used in a centrifugal pump, the seal system comprising:

an annular rotating sealing member adapted to be affixed to a rotatable shaft for rotation therewith;

an annular stationary sealing member which forms a fluid sealing interface together with said rotating sealing member;

a gland surrounding at least one of said annular stationary sealing member and said rotating sealing member, said gland including a flush passage defined therein for allowing flush liquid to flow toward said sealing interface; and an annular flush ring disposed between said gland and said sealing interface, said flush ring including a plurality of radially spaced apart flush passageways defined therein for allowing the flush liquid to flow toward said sealing interface from said flush passage from a plurality of different directions.

14. The seal system of claim 13, further comprising means for allowing the flush liquid to flow toward and into the fluid being pumped after the flush liquid passes said sealing interface.

15. The seal system of claim 13, further comprising an annular flush chamber located between said annular flush ring and said sealing interface, said flush chamber being in fluid communication with said plurality of flush passageways in said flush ring.

16. The seal system of claim 15, wherein said flush passageways are radially spaced around said entire shaft so that the flush liquid flows through said flush passageways and into said flush chamber so as to flush said sealing interface from radial locations encircling said shaft.

17. The seal system of claim 16, wherein said flush passage in said gland communicates with all of said flush ring passageways.

18. A flush system for flushing a seal in a pump, the system comprising:

said seal having an annular fluid sealing interface adapted to surround a rotatable shaft;

a gland surrounding at least a portion of said seal;

a stuffing box of the pump disposed adjacent said gland and also surrounding at least a portion of said seal; and an annular removable flush ring disposed between said gland and said stuffing box for enabling flushing of said seal via a plurality of flush holes defined in said flush ring, wherein said flush ring is annular in shape and is not part of said seal, and is not part of said gland.

19. The flush system of claim 18, wherein said flush holes are in fluid communication with (i) said sealing interface; and (ii) a flush port in said gland.

* * * * *